United States Patent [19]

Jacob

[11] Patent Number: 4,776,399

[45] Date of Patent: Oct. 11, 1988

[54] OIL-WELL SAFETY-VALVE AND TOOL FOR INSTALLING THE SAME

[75] Inventor: Jean-Luc Jacob, Lescar, France

[73] Assignee: Diamant Boart France-SA-Petrole Division, Serres Castet, France

[21] Appl. No.: 924,368

[22] Filed: Oct. 29, 1986

[30] Foreign Application Priority Data

Jul. 29, 1986 [FR] France ..... 86 11417

[51] Int. Cl.[4] ..... E21B 34/10

[52] U.S. Cl. ..... 166/321; 166/334

[58] Field of Search ..... 166/319, 321, 322, 324, 166/325, 326, 120, 332, 334

[56] References Cited

U.S. PATENT DOCUMENTS

| | | | |
|---|---|---|---|
| 3,799,258 | 3/1974 | Tausch | 166/322 |
| 3,865,141 | 2/1975 | Young | 166/322 |
| 4,252,197 | 2/1981 | Pringle | 166/322 |
| 4,294,314 | 10/1981 | Miyagishima et al. | 166/321 |
| 4,432,417 | 2/1984 | Bowyer | 166/322 |
| 4,473,122 | 9/1984 | Tamplen | 166/322 |
| 4,582,134 | 4/1986 | Cano et al. | 166/120 |
| 4,605,070 | 8/1986 | Morris | 166/322 |

FOREIGN PATENT DOCUMENTS

| | | | |
|---|---|---|---|
| 856475 | 12/1960 | United Kingdom | 166/322 |
| 2036134 | 6/1980 | United Kingdom | 166/322 |

*Primary Examiner*—Stephen J. Novosad
*Assistant Examiner*—William P. Neuder
*Attorney, Agent, or Firm*—Harold H. Dutton, Jr.

[57] ABSTRACT

An oil-well safety valve comprising a movable shutter (11), an inner tubular slide (9), a return-spring (10) for the slide, hydraulic means for moving the slide downward by pressurization of a control fluid, a system (14) for anchoring the valve in a receiving sleeve (1) and packings (15, 16) at the contact of the receiving sleeve (1), the packings (15, 16) being located on either side of the control fluid intake; the anchoring system (14) being located above the packings and the return spring (10) being located below in a part of the sealed volume receiving the control fluid. The spring being mounted around the slide between a bushing (20) and a ring nut (19) for eliminating any danger of relaxation of the spring during disassembly.

9 Claims, 3 Drawing Sheets

OIL-WELL SAFETY-VALVE AND TOOL FOR INSTALLING THE SAME

This invention relates to a safety valve for insertion into an oil-well production pipe for opening and closing it. The invention furthermore relates to a tool facilitating the installation of the valve.

BACKGROUND AND OBJECTS OF THE INVENTION

The purpose of oil well safety valves is to automatically stop the effluent production if an accident takes place at the well head or downstream therefrom. Such valves are hydraulically controlled to open from the surface and close automatically by means of a strong return spring the moment there is a drop, accidental or controlled, in the hydraulic pressure. These valves have long been studied and improved upon, and they are in wide use, in particular in offshore wells.

However currently used valves incur several drawbacks. In the first place, the return springs in most existing valves are subjected to deposits or corrosion effects from fluids with which they are in contact. In some valves, for instance those described in the French patent application No. 2,536,783 and in the French certificate of addition application No. 2,555,246, the return spring is located in the circuit of the control fluid. However the circuit geometry is such that it cannot be entirely drained and the spring is arranged in such a way that at least in part it is surrounded by gases. The corrosion from these gases causes rapid degradation and aging of the spring. This is a serious drawback in practice because spring degradation is translated into the danger that the valve will not close when necessary.

Furthermore, assembly and disassembly of the existing valves are complex and even dangerous procedures because of the presence of the springs with high return forces which must be relaxed to permit overhauling the equipment. Qualified personnel are required to carry out this maintenance which is delicate on account of the large number of parts and seals that are present, and such skilled labor is not always available on site. Again, these valves with many moving parts entail costly manufacture due to the machining and quality assurance time they demand. And the number of seals they require necessarily compounds the danger of malfunction.

Accordingly, the primary object of the present invention is to provide an improved safety valve free of the above stated drawbacks.

A further object of the invention is to provide a valve wherein the return spring and the moving parts are permanently and very effectively lubricated, thereby substantially reducing the possibility of corrosion.

Another object of the invention is to eliminate the element of danger from the valve being disassembled by eliminating the dangers relating to the relaxation of the return spring.

Still another object of the invention is to provide a simplified valve with a reduced number of parts.

Yet another object of the invention is to provide a valve with a reduced number of seals and permitting easy access and easy exchange of the most exposed seals.

Still another object of the invention is to facilitate the maintenance and overhaul of the valves.

Still a further object of the invention is to provide a simple installing tool for putting the return spring in place.

To facilitate understanding, the valve of the invention is assumed to be in place in an oil well, with the terms "high", "low", "upper", "lower" referring to that position.

DESCRIPTION OF THE INVENTION

The safety valve according to the invention is of the type comprising a generally tubular valve body, a movable shutter located at the lower part of the body and biased toward its closed position, a tubular slide arranged to slide longitudinally inside the valve body in order to open the shutter by its descending motion, a return spring located in an annular housing between the slide and the valve body in such a way as to bias the slide toward a high position corresponding to the closure of the shutter, hydraulic means displacing the slide downwardly and including a control fluid inlet through the valve body and a sealed volume between the slide and the body for receiving the control fluid, the slide having a differential cross-section subjected to the pressure of the fluid contained in the sealed volume for receiving a downward force when the volume is pressurized, an anchoring system at the low part of the valve body and designed to fix this body in a receiving sleeve anchored in the production pipe, and lower and upper seal packings located around the valve body in order to seal the interface between the valve body and the receiving sleeve below and above the control-fluid inlet.

In one feature of the present invention, the packings on either side of the control-fluid intake are located immediately below and above the inlet, the anchoring system being located above the upper packing while the return spring is located below the lower packing in an annular housing comprising a portion of the sealed volume receiving the control fluid.

As will be more clearly understood below, the structure of the valve of the invention allows completely draining the sealed volume containing the control fluid when being pressurized, while the arrangement of the return spring ensures it will be totally immersed in the control fluid. This spring is sheltered from effluent or gas corrosion and may be made of a steel with a high Young's modulus lending itself to a time-stable, high return force.

In another feature of the invention, the return spring in an annular housing located around the slide, extends from an upper rest solidly joined to the slide to a lower bushing mounted in sliding manner around the slide, and with a lower stop limiting its downward travel relative to the slide, the bushing coming to rest at its low part against a shoulder inside the valve body.

This design facilitates valve maintenance because the return spring remains partly compressed around the slide when the valve body is disassembled, there being no danger at all of accidental spring relaxation.

An auxiliary ring is preferably inserted while around the slide between this slide's upper rest and the corresponding end of the spring. The auxilliary ring is mounted in sliding manner around the slide itself and is provided at its periphery with a cavity to fix it in place by an assembling tool. The lower sliding bushing also is provided with a similar cavity on its periphery so it can be fixed in place by an assembling tool. In this manner the return spring can be assembled and if necessary disassembled without danger and in easy manner using a suitable tool of very simple design.

The invention also relates to an installation tool comprising essentially a frame extending along an axis, two members with retracting studs mounted on the frame at different levels and designed to respectively keep in place the bushing and the auxiliary ring of the valve, and a clamping rod with rest members resting on the bushing and the ring to compress the valve spring.

In a preferred embodiment, which facilitates changing the packings and more generally valve maintenance, the valve body comprises several tubular parts fastened to each other and including an upper seal support externally provided with an upper packing insertion notch and perforated below with an aperture for the control fluid inlet, a spring case extending around the spring and screwed by an upper heel on the upper seal support, the upper heel being provided externally with an insertion notch for the lower packing, a tubular spacer around the upper seal support between the lower and upper packings and perforated by an aperture matching the aperture for the control fluid inlet, a lower sleeve screwed to the base of the spring case and within same forming the above mentioned shoulder on which rests the lower sliding bushing, the lower sleeve having the shutter at its low part.

Other features, objects and advantages of the invention will become apparent from the description below in relation to the attached drawings which show in illustrative but non-restrictive manner a preferred embodiment and which are an integral part of the invention.

DETAILED DESCRIPTION OF THE INVENTION

Figure 1:
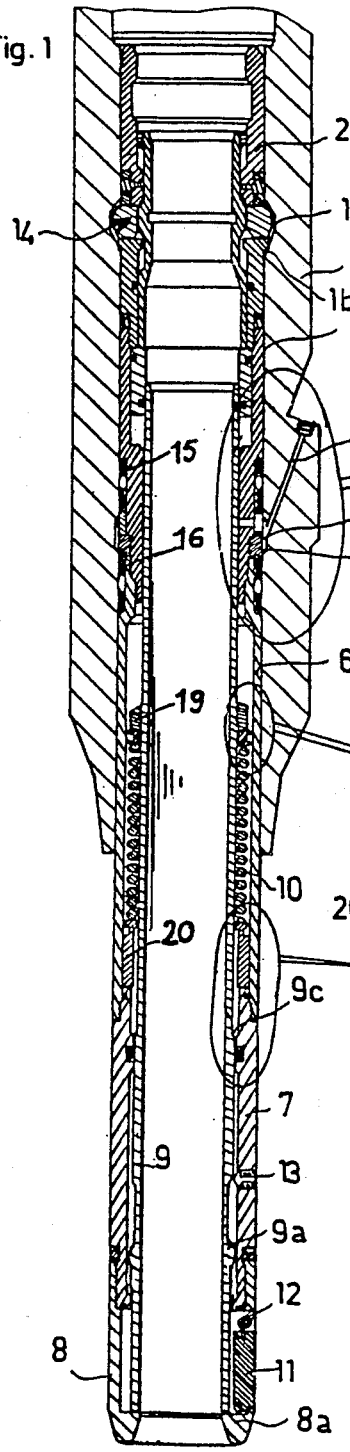
FIG. 1 is a longitudinal sectional view in a vertical plane of a valve of the invention in open position.
Figure 2:
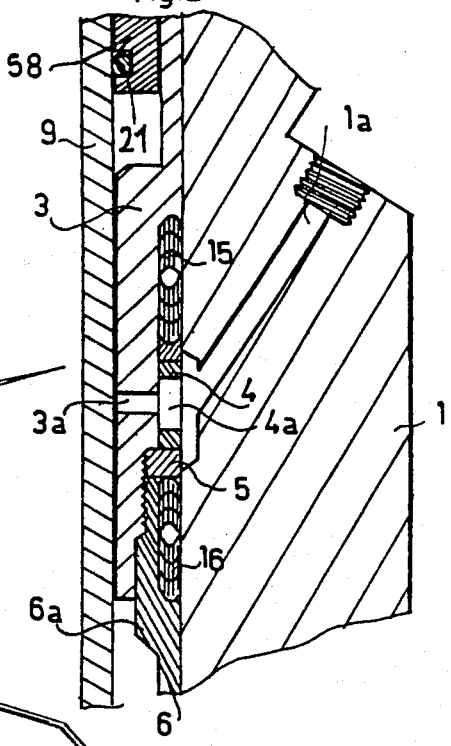
FIGS. 2, 3 and 4 are enlarged sectional views of portions of the valve.
Figure 4:
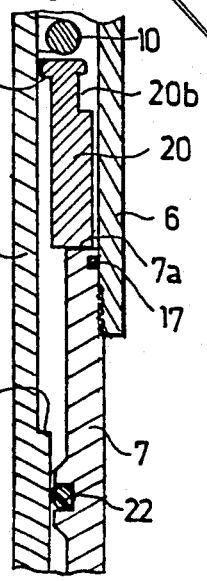
Figure 3:
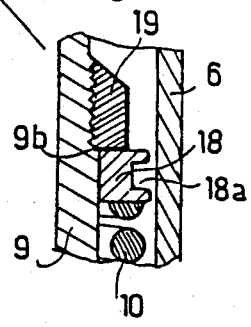

The illustratively shown safety valve of FIGS. 1–6 is intended for insertion into an oil well production pipe having a receiving sleeve 1. This receiving sleeve is typically provided with an inlet conduit 1*a* of control fluid, and anchoring groove 1*b* and valve stop means (shoulder 1*bi*).

The valve includes a generally tubular valve body comprising several tubular parts fastened to each other, including an upper lock body 2, an upper seal support 3, a tubular spacer 4, a locking ring-nut 5, a spring case 6, a lower sleeve 7, a shutter 8.

Figure 5:
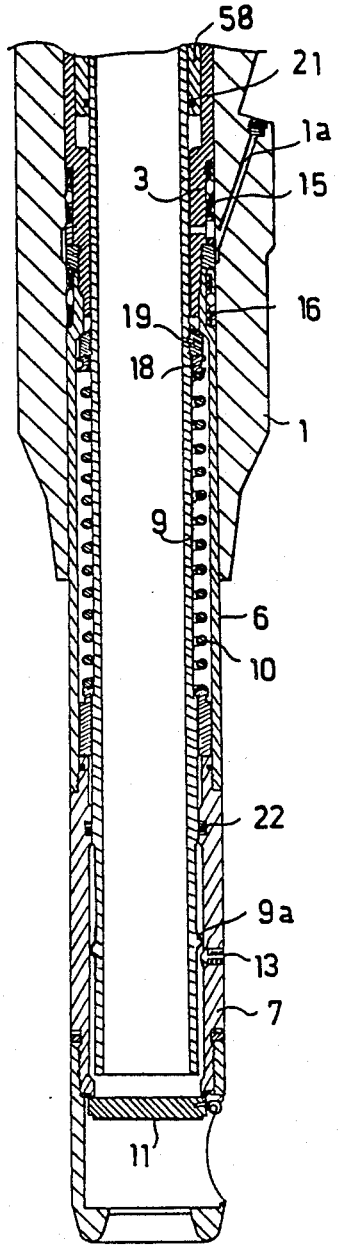
FIG. 5 is a longitudinal sectional view of the valve in the closed position.

A tubular slide 9 is mounted within the valve body where it can slide longitudinally between a low position (corresponding to open) shown in FIG. 1 and a high position (corresponding to close) shown in FIG. 5. This slide is biased toward its upper position by a return spring 10 and is hydraulically controlled downward by the control fluid passing through the conduit 1a when same is pressurized.

At the lower part, the shutter body 8 comprises a movable shutter means, in this example a flap 11 hinging on the body so as to pivot between a retracted open position when it is sideways (FIG. 1) and a closed position where it seals the valve body by resting against a seal of this valve body (FIG. 5). The flap 11 is biased toward the closed position by a spring 12 mounted around its hinge shaft. It should be noted that this shutter means is known per se and may be of another type, in particular a ball-type, wherein the sealing is accomplished by a spherical part moving longitudinally with an associated rotation between an open and a closed position (with a spring biasing the ball toward the closed position).

Due to the hydraulic control, the slide 9 moves downward until coming to a stop against the valve tip 8*a*. Thereupon the slide forces back the shutter 11 and keeps it open. If the control fluid pressure drops by accident or intentionally, the return spring 10 moves the slide upward into its high position where it is retracted within the lower sleeve 7 (FIG. 5). The shutter 11 then is freed and closes under the action of its own spring 12.

The lower sleeve 7 is conventionally provided with a compensating or balancing gate 13 which at the onset, during the descent of the slide, is actuated by a slide cam 9a in order to allow balancing the pressures on either side of the shutter 11.

Opposite this shutter, the lock body 2 contains an anchoring system with dogs 14 which may of any known type or of the type described in the U.S. patent application entitled "SAFETY VALVE FOR OIL WELLS AND INSTALLATION TOOL FOR THE VALVE" of Jean-Luc Jacob and filed simulatneously herewith, the specification of which is incorporated herein by reference. However, this system is outside the scope of the present application and therefore shall not be described in detail. Its purpose is to assure that when placed in the production pipe, the valve will be reliably anchored in the receiving sleeve 1.

The upper seal support 3 is screwed to the base of the lock body 2. This seal support is provided externally with a downward open notch the shape of which permits inserting an upper packing 15. This packing, which in particular may be of the herringbone type, is located immediately below an aperture 3*a* for the control fluid inlet in the upper seal support.

The packing 15 is locked in its notch by the tubular spacer 4 extending around the upper seal support 3 and itself perforated by an aperture 4*a* for the intake of control fluid. The apertures 3*a* and 4*a* do match each other and the intake conduit 1*a* of the receiving sleeve when the valve is inside latter.

The spring case 6 enclosing the return spring 10 is screwed on the upper seal support 3 by an upper heel 6*a*. This heel is provided externally with an upwardly open notch having a shape permitting the insertion of a lower packing 16. This packing which in particular is of the herringbone type is thereby positioned immediately below the fluid intake apertures. It is locked in its notch by the ring-nut 5 which in turn is screwed around the upper seal support 3. This ring-nut 5 furthermore locks the tubular spacer 4 (of which the low part rests against the upper side of the ring nut); also, it forms a stop limiting the screwing procedure of the heel 6*a* of the case 6.

At its base, this heel 6*a* forms an inner shoulder limiting the upward motion of the slide 9 by forming a stop for its below-mentioned ring nut 19.

At its low part, the spring case 6 is screwed around the lower sleeve 7 which forms a shoulder 7*a* inside the case. A seal 17 is inserted to seal the valve body at that level.

Since the valve anchoring system 14 is located above the two packings 15 and 16, the return spring 10 is opposite and below these packings in an annular housing bounded by the outer side of the slide 9 and the inner side of the case 6. The high end of this spring 10 rests against an auxiliary assembly ring 18 mounted around the slide 9 so as to slide along it. This auxiliary ring is provided on its periphery with a cavity 18*a*, in particular a circular groove, which, as shown further below, allows locking it during assembly.

The auxiliary ring 18 when in the high position rests against a ring nut 19 screwed around the slide 9 which for that purpose is provided with a thread over a zone of its outer surface. At the end of the screwing procedure, the ring nut 19 comes to rest against a small shoulder 9*b* on the outer slide surface between two segments of different diameters.

The low end of the spring 10 rests against a lower bushing 20 sliding around the slide 9. A lower stop 9*c* limits the downward course of the bushing 20 relative to the slide. This stop 9*c* comprises of a shoulder on the outer surface of the slide 9 between two segments of different diameters. The bushing 20 has a bore of two cross-sections comprising a rest side against the shoulder.

When in its low position relative to the valve body, this bushing 20 comes to rest against the inner shoulder 7*a* formed by the upper side of the sleeve 7.

The bushing 20 furthermore has a recess 20*b* on its periphery, in particular a circular groove permitting it to be fixed in place during assembly in the same manner as the auxiliary ring 18.

Figure 6:
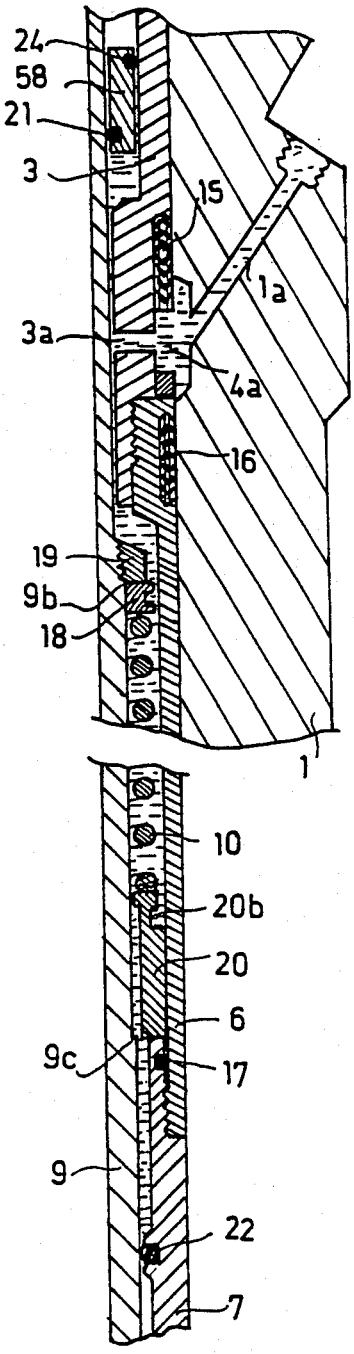
FIG. 6 is a partial sectional view showing the sealed volume containing the control fluid, and FIGS. *7a*, *7b* and *7c* are schematic views of the installing tool of the invention and its use.

The control fluid comprises a lubricant liquid and passes through the conduit 1*a* and the apertures 4*a* and 3*a* into the valve body, being stopped at the interface between the valve body and the receiving sleeve by the packings 15 and 16 directly on either side of the intake apertures and filling a sealed volume between the slide and the valve body diagrammatically shown in FIG. 6.

This sealed volume is bounded at the interface between the slide and the valve body on one hand by an upper seal 21 above the fluid intake and resting against an upper slide segment of specified diameter and on the other hand by a lower seal 22 located in a groove below and near the lower end of the return spring 10 and resting against a lower segment of the slide with a larger diameter than that of the above mentioned upper segment.

The difference in the diameters of these two slide segments is defined by the shoulders 9*b* and 9*c*. The control fluid therefore acts downwardly on the slide due to the differences in cross-sections.

The lower seal 22 is located in a groove of the sleeve 7 so as to be below and near the bushing 20. The seals 21 and 22 in particular are O-rings.

It should be noted that in the example shown the upper seal 21 is located in a groove of a shuttle-piston 58 which is part of the type of anchoring system described in the aforementioned patent application entitled "SAFETY VALVE FOR OIL-WELLS AND INSTALLATION TOOL FOR THE VALVE". A complementary seal 24 therefore is provided on the outer surface of the shuttle piston to assure its sealing at its interface with the valve body. (At the onset of the pressurization of the control fluid, this shuttle piston 58 is moved upward to a stop position in order to implement the anchoring).

There is no shuttle piston 58 in a conventional anchoring system and the upper seal 21 is directly placed in a groove of the upper seal support 3.

The new valve structure described above offers many advantages relative to the conventional valves.

Most importantly, when the fluid control conduit is pressurized, the return spring 10 and the moving parts (in particular the bushing 20) are totally immersed in the lubricant liquid and insulated from the effluent; the geometry of the sealed volume allows draining this volume which preserves this spring and those parts from any exposure to the corrosive gases. Therefore the return spring and those parts are protected against any corrosion or deposition; under these conditions, the spring may be made of a steel with a high Young's modulus so as to increase its performance and so that the valve can be used at greater depths. Moreover, the danger of malfunction in the closed position is substantially reduced relative to the known valves.

The valve can be disassembled without danger of relaxing the return spring 10. When the slide 9 is retracted, the spring remains captive around it between the upper ring nut 19 and the lower bushing 20 which comes to a stop against the shoulder 9*c* as indicated by FIG. 7*c*.

Figure 7A:
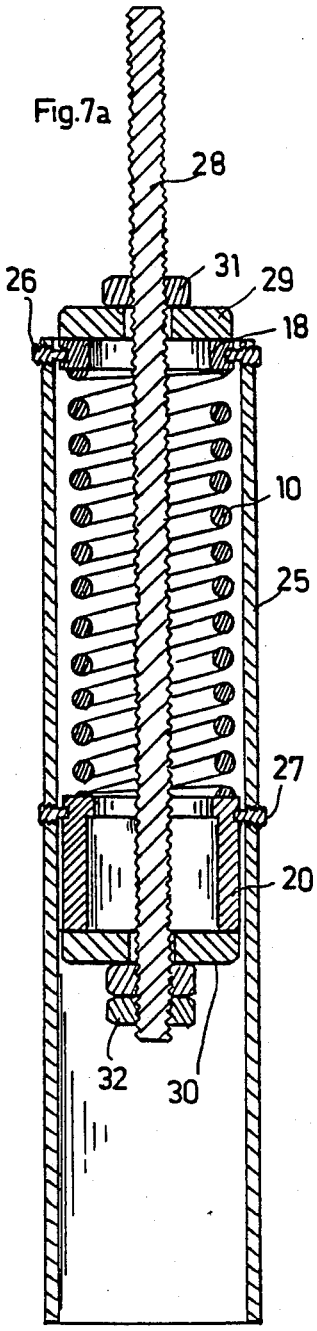

The spring itself can be easily assembled to or disassembled from the slide using an installing tool such as sectionally shown by FIG. 7*a*.

This tool includes a frame extending along an axis and in this instance comprising of a tube. This tubular frame is provided with retracting stud members such as 26 and 27 located at two different levels of the frame. These members at the two levels, which may be mere screws screwed into threaded holes in the frame, are apart by a distance which is slightly less than that between the auxiliary ring 18 and the bushing 20 of the sliding set of slide and spring (FIG. 7*c*). These screws 26 and 27 are designed to enter by their ends the cavities 18*a* and 20*b* of the ring and of the bushing.

The tool furthermore includes a clamping rod 28 provided with rest washers 29 and 30 respectively on the auxiliary ring 18 and on the bushing 20. Nuts 31, 32 are associated with these washers to keep them along the rod 28.

The return spring 10 is mounted around the slide 9 in the following manner. The bushing 20 is put in place around the clamping rod 28 against the rest member 30, 32. The relaxed spring next is placed around the bushing 20. The auxiliary ring 18 and the rest washer 29 then are made to cover the spring; the associated nut 31 permits compressing the spring until the cavities of the bushing 20 and of the ring 18 match the holding screws 26 and 27.

Figure 7B:
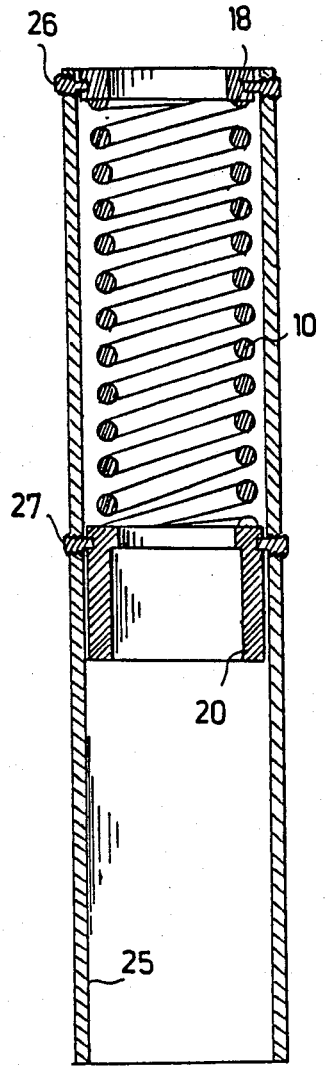
Figure 7C:
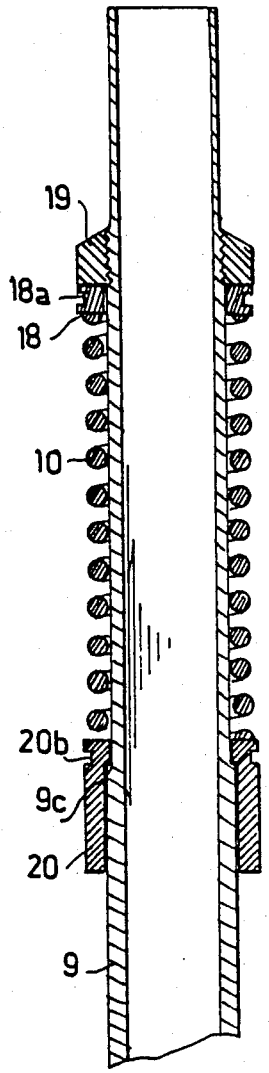

Thereupon these screws are turned and the clamping rod 28 is disassembled by unscrewing one or both its nuts 31, 32. In this manner an assembly such as shown by FIG. 7*b* is obtained.

Next it suffices to slip the slide 9 by its lower part into this assembly and to screw the ring nut 19 around the slide: the spring 10 then is fixed in place around that slide at the beginning of the compression. The frame 25 now may be withdrawn by unscrewing the screws 26 and 27.

It should be noted that the valve of the invention is made up of a reduced number of moving parts and of seals relative to the known valves, whereby its manufacturing cost is reduced and maintenance is simplified. In particular, the packings 15 and 16 of this valve are easily exchanged at the site without completely disassembling this valve. This is an essential advantage in practice because these packings undergo friction when the valve is lowered and risk degradation during these steps.

The packings are changed by unscrewing the case 6 and the upper seal support 13 to loosen them from each other, by unscrewing the ring nut 5, by removing the tubular spacer 4. Thereupon the old packings may be removed and the new ones put in place. Installation takes place by carrying out the reverse steps.

While this invention has been described as having preferred features and embodiments, it will be understood that it is capable of still further modification and adaptation within the spirit of the invention, and this application is intended to cover all variations, adaptations, modifications and alternatives as may fall within the spirit of the invention and the scope of the appended claims.

I claim:

1. A safety valve for insertion into an oil-well production pipe, for opening and closing the pipe said valve comprising a generally tubular valve body, a movable shutter (11) located at the lower part of said body and biased toward its closed position, a tubular slide (9) arranged to slide longitudinally within the valve body to cause by its descending motion the opening of the shutter, a return spring (10) located in an annular housing between the slide and the valve body in such a manner as to bias said slide upwardly toward an upper position corresponding to the closure of the shutter; means for hydraulically displacing the slide downward, comprising a control fluid intake (3*a*, 4*a*) through the valve body and a sealed volume between the slide and the body for receiving the control fluid, the slide having a difference in cross-section subjected to the pressure of the fluid contained in said sealed volume so as to undergo a downward force when said volume is pressurized; an anchoring system (14) at the upper part of the valve body and adapted to fasten in a receiving sleeve (1) housed in the production pipe; lower and upper seal packings (16 and 15) located around the valve body for sealing the interface between said valve body and the receiving sleeve below and above the control fluid intake; said packing (15, 16) on either side of the control-fluid inlet (3*a*, 4*a*) being immediately below and above said fluid inlet, the anchoring system (14) being above the upper packing (15) and the return spring (10) being below the lower packing (16) in an annular housing that is part of the sealed volume receiving the control fluid, said valve body further comprising a plurality of tubular parts fastened to each other, including an upper seal support (3) provided externally with an insertion notch for the upper packing (15) and perforated at a lower level by an aperture (3*a*) for the control fluid intake, a spring case (6) extending around the spring (10) and screwed by an upper heel (6*a*) onto the upper seal support (3), said upper heel being externally provided with an insertion notch for the lower packing (16); a tubular spacer (4) extending around the upper seal support (3) between the lower and upper packings (15, 16), said spacer (4) being perforated by an aperture (4*a*) matching the aperture (3*a*) of the control-fluid intake; a lower sleeve (7) screwed on the base of the spring case (6) and forming inside said case said shoulder (7*a*) against which will rest the lower bushing (20), said sleeve (7) having at its low part the shutter (11), and wherein said tubular spacer (4) is locked at its low part by a ring nut (5) screwed around the upper seal support (3), said ring nut (5) locking the lower packing (16) and forming a stop for the heel (6*a*) of the spring case.

2. A safety valve as in claim 1, and wherein the sealed volume receiving the control fluid is bounded at the interface between the slide and the valve body by an upper seal (21) in a groove above the control-fluid inlet and resting against an upper slide segment having a specific diameter, and by a lower seal (22) in a groove below and near the lower end of the return spring (10) and resting against a lower slide segment having a diameter larger than that of the said upper segment.

3. A safety valve as in claim 2, and wherein said spring (10) in the annular housing around the slide (9) extends from an upper rest (19) solidly joined to the slide to a lower bushing (20) sliding around said slide, a lower stop (9*c*) limiting its downward course relative to said slide, said bushing resting at its low part against a shoulder (7*a*) inside the valve body.

4. A safety valve as in claim 3 and wherein said lower seal (22) is located below and near the lower bushing (20).

5. A safety valve as in claim 3 and wherein said lower stop limiting the course of the bushing (20) relative to the slide (9) comprises a shoulder (9*c*) on the outer surface of said slide and between two segments with different diameters of said slide, said shoulder (9*c*) defining a difference in cross-section acted on by the control fluid, the bushing (20) having a bore with two cross-sections comprising a stop surface (20*a*) resting against said shoulder.

6. A safety valve as in claims 3 and wherein said upper rest solidly joined to the slide (9) includes a ring nut (19) screwed around said slide having a thread on an area of its outer surface.

7. A safety valve as in claim 6 and wherein said ring nut (19) at the end of its screwing procedure rests against a shoulder (9*b*) on the outer surface of the slide between two segments of said slide which have different diameters that define a difference in cross-sections acted on by the control fluid.

8. A safety valve as in claim 6 and including an auxiliary assembly ring (18) inserted around the slide (9) between the ring nut (19) and the corresponding end of the spring (10), said auxiliary ring being slidable along the slide and being provided on its periphery with a cavity (18*a*) permitting its fixation by an installing tool; the lower bushing (20) being provided on its periphery with a cavity (20*b*) permitting its fixation by the installing tool.

9. A safety valve as in claim 1 and including an auxiliary assembly ring (18) inserted around the slide (9) between the ring nut (19) and the corresponding end of the spring (10), said auxiliary ring being slidable along the slide and being provided on its periphery with a cavity (18*a*) permitting its fixation by an installing tool; the lower bushing (20) being provided on its periphery with a cavity (20*b*) permitting its fixation by the installing tool.

* * * * *